US012241695B2

(12) United States Patent
Viinikkala et al.

(10) Patent No.: US 12,241,695 B2
(45) Date of Patent: Mar. 4, 2025

(54) DEVICE FOR USE IN REFRIGERATION OR HEAT PUMP SYSTEM, AND REFRIGERATION OR HEAT PUMP SYSTEM

(71) Applicant: VAHTERUS OY, Kalanti (FI)

(72) Inventors: Reima Viinikkala, Lokalahti (FI); Mauri Kontu, Kalanti (FI); Valtteri Haavisto, Rusko (FI)

(73) Assignee: VAHTERUS OY, Kalanti (FI)

( * ) Notice: Subject to any disclaimer, the term of this patent is extended or adjusted under 35 U.S.C. 154(b) by 230 days.

(21) Appl. No.: 17/917,230

(22) PCT Filed: Mar. 30, 2021

(86) PCT No.: PCT/FI2021/050224
§ 371 (c)(1),
(2) Date: Oct. 5, 2022

(87) PCT Pub. No.: WO2021/205063
PCT Pub. Date: Oct. 14, 2021

(65) Prior Publication Data

US 2023/0175784 A1 Jun. 8, 2023

(30) Foreign Application Priority Data

Apr. 6, 2020 (FI) ..... 20205366

(51) Int. Cl.
*F28D 7/02* (2006.01)
*F25B 1/00* (2006.01)
(Continued)

(52) U.S. Cl.
CPC ..... *F28D 9/0043* (2013.01); *F25B 1/005* (2013.01); *F25B 39/00* (2013.01); *F25B 40/02* (2013.01);
(Continued)

(58) Field of Classification Search
CPC ..... F25B 1/005; F25B 39/00; F25B 40/02; F25B 2339/0241; F25B 2400/13;
(Continued)

(56) References Cited

U.S. PATENT DOCUMENTS 4,437,322 A 3/1984 Ertinger
10,401,094 B2 * 9/2019 Taras ..... F28D 9/005

FOREIGN PATENT DOCUMENTS

EP 2 594 884 5/2013
EP 3 637 017 4/2020
(Continued)

OTHER PUBLICATIONS

International Search Report and Written Opinion of the ISA dated Jun. 23, 2021, for PCT/FI2021/050224, 12 pages.
(Continued)

*Primary Examiner* — Davis D Hwu
(74) *Attorney, Agent, or Firm* — NIXON & VANDERHYE

(57) ABSTRACT

A device for use in a refrigeration or heat pump system. A device includes an outer casing which includes a longitudinal cylindrical shell and end plates arranged at both ends of the shell, and at least three units of the refrigeration or heat pump system arranged inside the same common outer casing, which units are selected from the group consisting of an evaporator, a superheater, an economizer, a condenser, a desuperheater, a sub-cooler and an oil cooler.

18 Claims, 3 Drawing Sheets

(51) Int. Cl.

| | |
|---|---|
| ***F25B 39/00*** | (2006.01) |
| ***F25B 40/02*** | (2006.01) |
| ***F25B 40/06*** | (2006.01) |
| ***F28D 9/00*** | (2006.01) |
| ***F28F 9/00*** | (2006.01) |
| *F28D 21/00* | (2006.01) |

(52) U.S. Cl.
CPC ..... *F25B 40/06* (2013.01); *F28D 9/0006* (2013.01); *F28D 9/0093* (2013.01); *F28F 9/005* (2013.01); *F25B 2339/0241* (2013.01); *F25B 2400/13* (2013.01); *F25B 2500/01* (2013.01); *F25B 2500/18* (2013.01); *F28D 2021/0066* (2013.01)

(58) Field of Classification Search
CPC .. F25B 2500/01; F25B 2500/18; F28D 9/006; F28D 9/0093; F28D 2021/0066; F28F 9/005
USPC ..... 165/164
See application file for complete search history.

(56) References Cited

FOREIGN PATENT DOCUMENTS

| | | |
|---|---|---|
| WO | 2012/107645 | 8/2012 |
| WO | 2013/150175 | 10/2013 |

OTHER PUBLICATIONS

Finnish Search Report dated, for FI Application No. 20205366, dated Nov. 6, 2020, 1 page.

* cited by examiner

DEVICE FOR USE IN REFRIGERATION OR HEAT PUMP SYSTEM, AND REFRIGERATION OR HEAT PUMP SYSTEM

This application is the U.S. national phase of International Application No. PCT/FI2021/050224 filed Mar. 30, 2021 which designated the U.S. and claims priority to FI 20205366 filed Apr. 6, 2020, the entire contents of each of which are hereby incorporated by reference.

FIELD OF THE INVENTION

The present invention relates to a device for use in a refrigeration or heat pump system according to the independent claim, and a refrigeration or heat pump system.

BACKGROUND OF THE INVENTION

As simplified, a common refrigeration system comprises a compressor, which delivers a compressed refrigerant to a condenser. From the condenser, the refrigerant passes through an expansion device to the evaporator and from the evaporator the refrigerant returns to the compressor. These kind of vapor-compression refrigeration systems are closed systems, where the refrigerant circulates and undergoes phase changes. A circulating refrigerant is compressed to a higher pressure, resulting a higher temperature as well. The hot, compressed refrigerant gas is then at a temperature and pressure at which it can be condensed with cooling medium, such as cooling water or cooling air. This is a phase of the vapor-compression refrigeration system, wherein the circulating refrigerant rejects heat from the system and the rejected heat is carried away.

The above provides a brief understanding of the fundamental concept of the refrigeration system. Of course, the refrigeration systems are utilized in combination with many configuration variations and optional devices and features. For example, an enhancement technique known as an economizer cycle has been utilized in refrigerant systems. The economizer circuit increases the capacity and efficiency of a refrigerant system. A superheater is also commonly used in combination with the evaporator. The refrigeration system may also comprise a desuperheater and a sub-cooler for improving condensation of the refrigerant. Further, the system typically comprises an oil separator and an oil cooler, since the compressor needs oil to work properly.

A heat pump system comprises same main components as the refrigeration system and so employs the same vapor-compression cycle as the refrigeration system but in the opposite direction.

Commonly, all components of the refrigeration or heat pump system are located separately, as own device. These kinds of systems are typically complex. Therefore, the space required for the refrigeration or heat pump system is remarkable, both the area and the space in height direction. The units of the refrigeration or heat pump arrangement located separately from each other require also piping for circulating a refrigerant from one unit to another, which also increase a space required for the arrangement. Therefore, there is a need for simpler and cost-efficient heat exchanger structures in which two or more units of the refrigeration or heat pump system are combined in one common device.

The patent publication WO2013/150175 discloses an apparatus, which comprises an evaporator and a condenser inside one outer casing in such a manner that the evaporator and the condenser are separated from each other by a partition wall.

SUMMARY OF THE INVENTION

It is an object of the present invention to reduce or even eliminate the above-mentioned problems appearing in prior art.

It is an object of the present invention to provide a device for use in a refrigeration or heat pump system, especially in vapor-compression cycle, which device combines three or more units of the refrigeration or heat pump system in one common device and hence makes possible to decrease the size of the refrigeration or heat pump system and to simplify installation work.

It is especially an object of the present invention to provide a compact device for use in a refrigeration or heat pump system, which decrease a number of the separate devices of the refrigeration or heat pump system.

Further, it is an object of the present invention to provide a device for use in a refrigeration or heat pump system, which can be easily manufactured using standard sized parts of heat exchangers.

In order to achieve among others, the objects presented above, the invention is characterized by what is presented in the characterizing parts of the enclosed independent claims. The other, dependent claims present some preferred embodiments of the invention.

A typical device according to the invention for use in a refrigeration or heat pump system comprises

- an outer casing which comprises a longitudinal cylindrical shell and end plates arranged at both ends of the shell, and
- at least three units of the refrigeration or heat pump system arranged inside the same common outer casing, which units are selected from the group consisting of an evaporator, a superheater, an economizer, a condenser, a desuperheater, a sub-cooler, an oil cooler and a reservoir, wherein the device comprises

- (i) at least a first plate pack and a second plate pack having own inlet and outlet connections and arranged adjacent to each other inside the common outer casing for forming a first unit and a second unit of the system, and further a third unit of the system is formed to the first and/or the second plate pack by arranging a baffle plate inside a flow passage of said plate pack, or
- (ii) two separate parts of the outer casing, which are formed by arranging a first partition wall between the parts inside the outer casing, wherein a first part of the outer casing comprises at least two units of the system, which units of said part are formed by
  - arranging at least a first plate pack and a second plate pack adjacent to each other inside said part of the outer casing for forming a first unit and a second unit of the system, wherein said plate packs have own inlet and outlet connections, or
  - arranging at least a plate pack inside said part of the outer casing, wherein at least a baffle plate is arranged inside a flow passage of the plate pack for forming at least two units of the system to the plate pack inside said part of the outer casing, and a second part of the outer casing comprises at least one unit of the system, or
- (iii) at least three separate parts of the outer casing, which are formed by arranging a first partition wall and a second partition wall between the parts inside the outer casing, and each of the parts comprises at least one unit of the system.

A device of the present invention may be used as a component of a refrigeration or heat pump system, especially in vapor-compression based systems where a circulating refrigerant undergoes phase changes during circulation in the system. A typical refrigeration or heat pump system according to the present invention comprises a device according to the present invention.

The invention is based on the compact structure of the device for use in a refrigeration or heat pump system. A device according to the present invention comprises at least three units of the refrigeration or heat pump system inside the same common outer shell. The units are selected from the group consisting of an evaporator, a superheater, an economizer, a condenser, a desuperheater, a sub-cooler, an oil cooler and a reservoir. Each of the units of the refrigeration system selected from the group consisting of an evaporator, a superheater, an economizer, a condenser, a desuperheater, a sub-cooler, and an oil cooler comprises a stack of heat exchange plates (i.e. plate pack). The present invention provides a structure in which the units can be arranged inside the same common outer casing and providing a compact structure. The device according to the present invention requires less space and less piping for circulating a refrigerant from one unit to another. A device according to the present invention is also easy to assemble to a part of the refrigeration or heat pump system.

When different units of the refrigeration or heat pump system are based on the use of same kind of the plate packs, they can be easily arranged adjacent to each other to inside the same common outer casing or one plate pack can be divided into different functional units of the system. More units can be arranged inside the same outer casing by dividing the inside of outer casing to two, three or more separate parts, wherein each part may comprise one, two or more units of the refrigeration or heat pump system. The units of the refrigeration or heat pump system can be arranged adjacent to each other into the same stack of the heat exchange plates, and typically the adjacent units are selected in an order of the flow in the refrigeration or heat pump system, or on the basis of the temperature change required by the heat exchanger of said units.

According to a first embodiment of the invention, a device comprises at least three units selected from the group consisting of an evaporator, a superheater, an economizer, a condenser, a desuperheater, a sub-cooler and an oil cooler and said units of the refrigeration or heat pump system are arranged to the adjacent first and second plate packs arranged inside the cylindrical outer casing. Said adjacent plate packs have own inlet and outlet connections, i.e. they have own pack side circulations. A third unit of the system is formed to the first and/or the second plate pack by arranging a baffle plate inside one flow passage of said plate pack for forming a third unit to the same plate pack. A device according to this embodiment provides a simple and compact structure, where the adjacent plate packs providing certain units of the refrigeration or heat pump system are arranged inside the same common outer casing.

According to a second embodiment of the invention, a device comprises at least three units selected from the group consisting of an evaporator, a superheater, an economizer, a condenser, a desuperheater, a sub-cooler, an oil cooler and a reservoir, and said units of the refrigeration or heat pump system are arranged to two separate part of the outer casing, which parts are formed by arranging a partition wall between the parts inside the outer casing. Thus, the partition wall divides the inside of the outer casing in a horizontal direction to a first part and a second part. A first part of the outer casing comprises at least two units of the refrigeration or heat pump system, wherein said part comprises at least two units of the system, which units of said part are formed by arranging at least a first plate pack and a second plate pack adjacent to each other inside said part of the outer casing for forming a first unit and a second unit of the system, wherein said plate packs have own inlet and outlet connections, or arranging at least a plate pack inside said part of the outer casing, wherein at least a baffle plate is arranged inside a flow passage of the plate pack for forming at least two units of the system to the plate pack inside said part of the outer casing, and a second part of the outer casing comprises at least one unit of the system.

In a second embodiment of the invention, a second part of the outer casing comprises at least one unit of the refrigeration or heat pump system. A first part of the outer casing may comprise two or more units of the refrigeration or heat pump system, which are formed by two or more adjacent plate packs and/or a baffle plate arranged inside a flow channel of the plate pack.

According to a third embodiment of the invention, a device comprises at least three units selected from the group consisting of an evaporator, a superheater, an economizer, a condenser, a desuperheater, a sub-cooler, an oil cooler and a reservoir, and said units of the refrigeration or heat pump system are arranged to at least three separate parts of the outer casing which parts are formed by arranging a first partition wall and a second partition wall between the parts inside the outer casing. Thus, the partition walls divide the inside of the outer casing in a horizontal direction to a first part, a second part and a third part. Each part comprises at least one unit of the system.

In an embodiment, the device may comprise three or more partition walls, wherein the device comprises four or more separate parts of the outer casing.

The units of the device according to the present invention selected from the group the group consisting of an evaporator, a superheater, an economizer, a condenser, a desuperheater, a sub-cooler and an oil cooler are constructed by using welded Plate and Shell-type heat exchangers. Using the standard size heat exchange plates and one common outer casing provides cost-effective way to produce vapor-compression based refrigeration or heat pump systems.

A device according to the present invention is typically used in a large-scale refrigeration or heat pump systems. A device according to the present invention may be a part of the industrial scale refrigeration or heat pump system.

DESCRIPTION OF THE DRAWINGS

The invention will be described in more detail with reference to appended drawings, in which.

DETAILED DESCRIPTION OF THE INVENTION

Figure 1:
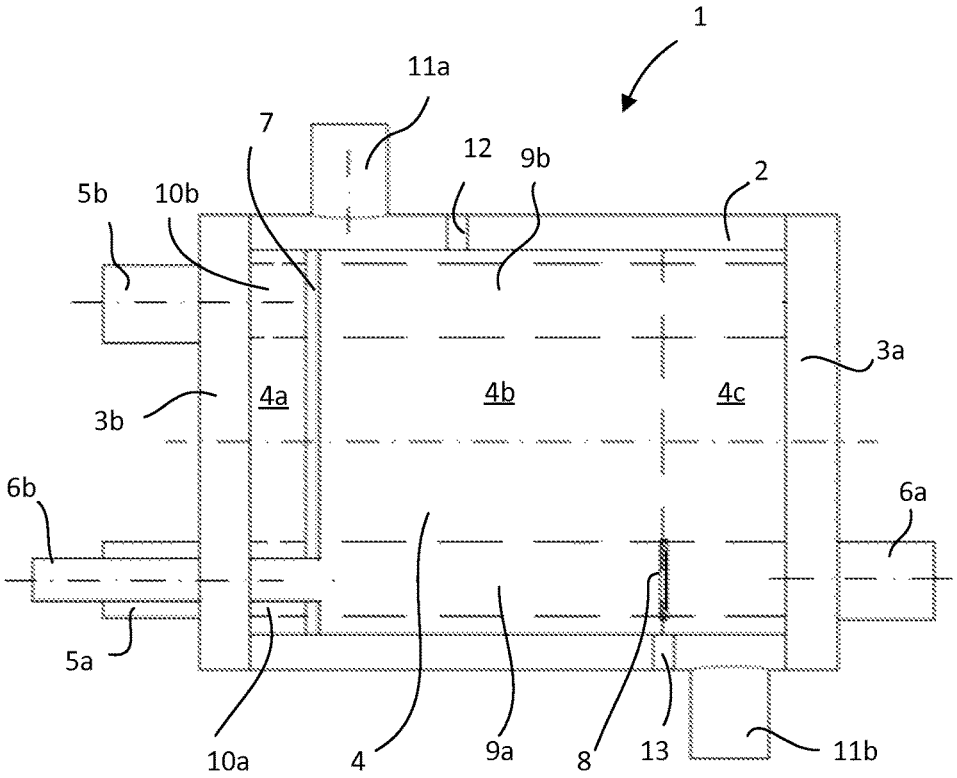
FIG. 1 shows a cross section of a device according to a first embodiment of the present invention for use in a refrigeration or heat pump system.

In a device according to the present invention, at least three units of a refrigeration or heat pump system are arranged inside the same common outer casing. At least three units of the refrigeration or heat pump system are selected from the group consisting of an evaporator, a superheater, an economizer, a condenser, a desuperheater, a sub-cooler, an oil cooler and a reservoir. In an embodiment of the present invention, at least three units of the refrigeration or heat pump system are selected from the group consisting of an evaporator, a superheater, an economizer, a condenser, a desuperheater, a sub-cooler an oil cooler, and a device may further comprise at least one reservoir, i.e. at least three units of the refrigeration or heat pump system are selected from the group consisting of an evaporator, a superheater, an economizer, a condenser, a desuperheater, a sub-cooler, an oil cooler and optionally a reservoir. A unit refers to one equipment of the refrigeration or heat pump system. A unit selected from the group the group consisting of an evaporator, a superheater, an economizer, a condenser, a desuperheater, a sub-cooler and an oil cooler comprises a stack of plate heat exchange plates. Typically, these units of the device according to the present invention are based on the Plate and Shell-type heat exchangers. In addition, a unit may be a reservoir. A reservoir refers to a space, which may also be called a receptacle or chamber for holding a liquid or a gas. Typically, a reservoir is a space circulated by the walls and having inlet and/or outlet connection(s). In an embodiment of the present invention a reservoir may be a space circulated by the outer casing or outer casing and the partition wall(s). It may be a reservoir e.g. for an oil or a refrigerant. A refrigeration or heat pump system according to the present invention refers to all kind of refrigeration or heat pump systems comprise at least three units select from the group consisting of an evaporator, a superheater, an economizer, a condenser, a desuperheater, a sub-cooler, an oil cooler and a reservoir. A device according to the present invention can be a part of the refrigeration or heat pump system. A refrigeration or heat pump system comprises at least one device according to the present invention.

A device according to the present invention comprises an outer casing that comprises a longitudinal cylindrical shell and end plates arranged at both ends of the shell. A cylindrical shell is usually horizontal, and the end plates of the outer casing are vertical. The term longitudinal direction of the outer casing or cylindrical shell used in this text typically means the horizontal direction. For example, if the cylindrical shell of the outer casing is a straight circular cylinder, then its longitudinal direction is the same as the direction of the central axis of the cylinder in question.

In a device according to the invention, the outer casing functions as a pressure vessel. Hence, a device according to the present invention provides three or more functional units of the refrigeration or heat pump system inside one pressure vessel.

Each unit of the refrigeration or heat pump system according to the present invention selected from the group the group consisting of an evaporator, a superheater, an economizer, a condenser, a desuperheater, a sub-cooler, and an oil cooler are formed by a stack of heat exchange plates, i.e. each unit comprises a plate pack formed of heat exchanger plates having at least two openings and arranged on top of each other. A plate pack comprises ends at the direction of the heat exchange plates and an outer surface defined by the outer edges of the heat exchange plates. In an embodiment of the invention, both ends of the plate pack may comprise a separate support end plate. The plate packs are made up of several plate pairs. Each plate pair is typically formed of two heat exchange plates that are attached together at least at their outer periphery. Each heat exchange plate has at least two openings for a flow of a heat exchange medium. Adjacent plate pairs are attached to each other by attaching the openings of two adjacent plate pairs to each other. The inner parts of which plate pairs are arranged in connection with each other via flow passages formed by the openings of the heat exchange plates. In a plate pack, a heat exchange medium can flow from a plate pair to another via the openings. In a preferred embodiment according to the present invention, heat exchange plates are typically circular heat exchange plates, wherein the plate pack is mainly circular cylinder in shape. A plate pack may also be formed of e.g. semicircle or ellipse heat exchange plates. A longitudinal direction of the plate packs is same as the longitudinal direction of the cylindrical shell. A plate pack used in the device according to an embodiment of the present invention are mainly circular cylinders in shape, wherein a longitudinal direction of the plate pack corresponds with the longitudinal direction of the cylindrical shell.

A plate heat exchanger arrangement according to the invention comprises an inlet connection and an outlet connection for each plate pack, which connections are connected with the flow passages of said plate pack. The primary circuit of the plate pack is thus formed between the inlet and outlet connection of said plate pack. The inlet and outlet connections of the secondary circuit are arranged through the outer casing in connection with the inner side of the outer casing, in the spaces between the plate pairs. Typically, the primary circuits of the plate packs and the secondary circuit are separate from each other, i.e. the heat exchange medium flowing in the inner part of a plate pack cannot get mixed with the heat exchange medium flowing in the outer casing and with the heat exchange medium flowing in the inner part of another plate pack.

According to an embodiment of the present invention a plate pack structure provides a completely welded structure and it does not affect the pressure-tightness of the device. A plate pack according to the present invention may also be semi welded or it may comprise seals between the plates.

The plate packs according to the invention may comprise a different amount of the plate pairs formed of heat exchange plates. The plate packs of the units may be dimensioned on the basis of the requirement of an application.

A refrigeration or heat pump system according to the present invention comprises at least one device according to present invention. Further, a refrigeration system comprises all required components of said system, such as a compressor, an expansion device, piping for circulating refrigerant etc. and the units which are not a part of the device according to the present invention. A vapor-compression refrigeration or heat pump system according to the present invention is a closed loop system, in which system a refrigerant circulates in the closed cycle and undergoes phase changes.

In a vapor compression refrigeration or heat pump system according to the invention, a refrigerant may be any suitable refrigerant.

There are many variations to arrange at least three units of a refrigeration or heat pump system into the device of the present invention. A device according to the present invention can comprise at least three units of a refrigeration or heat pump system inside one common outer casing, wherein the inside of the outer casing is also common in all units, or the inside of outer casing is divided into at least two or three separate parts by an intermediate wall(s). When the inside the outer casing is divided by one intermediate wall for forming two parts of the outer casing, two units of the refrigeration or heat pump system is arranged inside a first part of the outer casing and a second part of the outer casing comprises at least one unit of the refrigeration or heat pump system. When the inside the outer casing is divided by two intermediate walls for forming three parts of the outer casing, at least one unit of the refrigeration or heat pump system is arranged inside each part of the outer casing. In an embodiment, the device may comprise three or more partition walls, wherein the device comprises four or more separate parts of the outer casing. These different embodiments according to the present invention are described more detailed below.

A First Embodiment According to the Present Invention

According to a first embodiment of the invention, a device comprises at least three units selected from the group consisting of an evaporator, a superheater, an economizer, a condenser, a desuperheater, a sub-cooler and an oil cooler and said units of the refrigeration or heat pump system are arranged inside the common cylindrical outer casing. A device may further comprise a reservoir. In an embodiment, one or more reservoir(s) may also be arranged inside the outer casing.

According to a first embodiment of the present invention, at least a first plate pack and a second plate pack having own inlet and outlet connections are arranged adjacent to each other inside the common outer casing for forming a first unit and a second unit of the refrigeration or heat pump system. At least the first plate pack or the second plate pack comprises a baffle plate inside a flow passage of the plate pack for forming a third unit of the system to said plate pack.

According to an embodiment, the adjacent first plate pack and the second plate pack having own inlet and outlet connections are separated by an intermediate plate, which is arranged between the units formed of said adjacent plate packs If a first plate pack and a second plate pack have same diameter, defined by the outer edges of the heat exchange plates, they can be formed to the same stack of the heat exchange plates by arranging simply an intermediate plate between the heat exchange plates, wherein the intermediate plate closes the connection through the flow passages from one unit to another. Alternatively, the adjacent first plate pack and the second plate pack having own inlet and outlet connections are formed from one plate pack and the baffle plates are arranged to the flow channels of said plate pack to close flow connections between the plate packs, wherein said plate pack is divided into the first plate pack and the second plate pack, i.e. the baffle plates closes the connection through the flow passages from one unit to another. In this description, these plate pack parts in one stack of heat exchange plates separated from each other by an intermediate plate or baffle plates in the flow channels is called as different plate packs.

According to a first embodiment of the present invention, a first plate pack and a second plate pack comprise own inlet and outlet connections, which are arranged in connection with the inner parts of said plate pack. The primary circuit of the first plate pack is formed between the inlet and outlet connection of said plate pack. The primary circuit of the second plate pack is between the inlet and outlet connection of said plate pack.

According to a first embodiment of the present invention, a first and/or a second plate pack can be further divided into the separate units of the refrigeration or heat pump system by arranging a baffle plate inside a flow channel of said plate pack, wherein two or more passes (flows through the same plate pack) can be formed through one plate pack and so one plate pack can comprise two or more units, i.e. functions of the refrigeration or heat pump system. In an embodiment of the present invention, a first plate pack and/or a second plate pack comprises one or more baffle plates for forming multiple passes to said plate pack.

According to an embodiment of the invention, the adjacent first and second plate pack has a substantially same diameter, defined by the outer edges of the heat exchange plates.

In an embodiment, where the first plate pack and the second plate pack have a substantially same diameter, defined by the outer edges of the heat exchange plates, at least one inlet or outlet connection of the second plate pack, which is divided into at least two units by a baffle plate, comprises a connection pipe, which is arranged inside a flow passage of the first plate pack between the end plate of the outer casing and the intermediate plate or baffle plate between the units, wherein an end of said connection pipe is attached to said intermediate plate for forming a connection to the flow passage of the second plate pack, and a second end of said connection pipe elongates through an end plate of the outer casing. This double connection pipe structure, i.e. through one opening in the end plate is arranged a connection to two plate packs, makes possible to arrange at least three units to two adjacent plate packs having same outer diameter. An end of the connection pipe is tightly attached to the intermediate plate or the baffle plate or it can be attached with a seal for forming a connection to the flow passage of the second plate pack, wherein the heat exchange mediums inside the plate packs cannot mix to each other. According to an embodiment of the present invention, a partition plate arranged between the adjacent plate packs has a thickness of about 5 to 20 mm. A partition plate is substantially thicker than the heat exchange plates of the plate pack and a support end plate of the plate pack. A baffle plate is any suitable structure arranged inside the flow channel for closing the connection through the flow passages from one unit to another.

According to a first embodiment of the invention, a first and a second plate pack may be formed of plate packs having a different diameter, defined by the outer edges of the heat exchange plates. In an embodiment of the invention, a first plate pack and a second plate pack are arranged adjacent to each other inside the common outer casing, and the first plate pack has a diameter, defined by the outer edges of the heat exchange plates, which is smaller than a diameter of the second plate pack. According to an embodiment of the present invention an intermediate plate, which is arranged between the adjacent plate packs, has a size which corresponds at least the size of the plate pack having the greater diameter. In an embodiment of the present invention, an intermediate plate has a size wherein the intermediate plate is in connection with the inner surface of the outer casing at least from one edge of the intermediate plate. The intermediate plate between the adjacent plate packs makes possible to provide a tight construction with plate packs having a different size, defined by the diameter of the heat exchange plates. In an embodiment of the present invention, an intermediate plate is arranged to elongate from an outer surface of the plate pack to an inner surface of the shell at one side of the plate pack and so the intermediate plate forms multiple passes for heat exchange medium in the shell side. According to an embodiment of the present invention, an intermediate plate arranged between the adjacent plate packs has a thickness of about 20 to 100 mm. An intermediate plate will support the structure of the plate packs and improves its pressure resistant.

The adjacent plate packs with different outer diameters make possible to arrange easily an inlet and/or outlet connection of a greater sized plate pack through the same end plate of the outer casing as the inlet and outlet connection of a smaller sized plate pack. According to an embodiment of the present invention, an inlet and/or outlet connection of the greater sized plate pack is arranged outside of the outer surface of the smaller sized plate pack.

According to the present invention, there may be more than two separate plate packs arranged adjacent inside the same common outer casing. In an embodiment of the invention, a device comprises a third plate pack arranged adjacent of the first plate pack or the second plate pack, wherein the third plate pack is separated from the adjacent plate pack by arranging an intermediate plate between them and/or by arranging the baffle plates to the flow channels of the plate pack to close flow connection between the plate packs. In an embodiment, at least one plate pack has a diameter greater than other plate packs. According to an embodiment of the present invention, an inlet connection and an outlet connection of a plate pack comprise a connection pipe, and they are arranged nested, wherein an outer diameter of inner connection pipe is smaller than a diameter of the outer connection pipe and the flow passage of the plate pack. When the inlet and outlet connections are arranged nested and connected to one flow channel of the plate pack, an inlet connection of the plate pack is formed by arranging a connection pipe through an outlet connection of the plate pack, wherein said inlet connection pipe elongates inside the flow passage of said plate pack and outlet connection pipe is attached to the end of the plate pack for forming connection to said flow channel. According to an embodiment of the present invention, an intermediate plate, arranged between the adjacent plate packs with different diameter, has a thickness of about 20-100 mm.

The plate packs according to a first embodiment of the present invention can be cooled/heated by using a single heat exchange medium flowing in the shell side. A shell side inlet and outlet connections can be formed regardless of the connections of the plate pack. In a typical embodiment according to the invention the shell side is common to the units of the system inside the outer casing. An inlet connection and an outlet connection for heat exchange medium flowing inside the shell are arranged through the outer casing, typically through the shell of the outer casing. An inlet and an outlet connection of the shell side may be arranged through the end plate(s) or through the shell, or any combination of them. In a preferred embodiment of the present invention, a single heat exchange medium flows in the shell side, i.e. the shell side is common in all plate packs.

According to an embodiment of the present invention, a separate stopper plate may be arranged between an outer surface of a plate pack and an inner surface of the shell at least to one side of the plate pack for forming multiple passes for heat exchange medium in the shell side.

In an embodiment according to the invention, when the condenser is one unit of the first embodiment of the present invention, the condenser may be a unit arranged to the second plate pack of the first embodiment according to the present invention, which second plate pack comprises a baffle plate inside a flow passage of the plate pack for dividing said plate pack to different units. A refrigerant to be condensed can be arranged to flow inside the plate pack, i.e. a refrigerant is a heat exchange medium flowing inner parts of the plate pack, wherein condensation takes place in pack side of the Plate and Shell-type heat exchanger. This decreases the amount of the refrigerant required in the system and pressure loss can be minimised in comparison to the systems where refrigerant is a heat exchange medium of the shell side circulation.

A Second Embodiment According to the Present Invention

According to a second embodiment of the present invention, a device comprises two separate part of the outer casing, which are formed by arranging a partition wall between the parts inside a shell of the outer casing.

According to an embodiment of the invention, when a first part of the outer casing comprises at least two units of the refrigeration or heat pump system, a second part of the outer casing comprises at least one unit of the refrigeration or heat pump system.

In an embodiment according to the invention, a shell of the outer casing is continuous shell from the first end plate to the second end plate of the outer casing, i.e. the shell is uniform in the longitudinal direction of said shell, and the shell is divided in the longitudinal direction of the shell to separate parts by a partition wall between the parts inside the shell. A partition wall is attached, preferably welded, to the inner surface of the shell. In another embodiment, a longitudinal cylindrical shell of the outer casing may be constructed from two parts, wherein the shell is continuous covering at least one part of the outer casing. Especially, when the size of the device is increased, the shell may be constructed from two separate parts which are attached, preferably welded to each other, wherein they form the longitudinal cylindrical shell of the outer casing. When the shell of the outer casing is formed from two parts, the partition wall may be arranged to the structure so that it is between the parts of the shell. According to the invention, the shell of the outer casing is constructed so that the diameter of the longitudinal cylindrical shell is substantially same in both module parts of the arrangement, i.e. the diameter of the shell of outer casing is substantially same from the first end plate to the second end plate of the outer casing.

In a typical embodiment, a partition plate divides the inside of the outer casing in horizontal direction to a first part and a second part. In a typical embodiment, a partition wall is arranged inside the horizontal cylindrical shell mainly vertically. In one embodiment of the invention, the thickness of the partition wall is typically 20-100 mm or 40-100 mm. A partition wall is typically made of same material as the outer casing. In an embodiment of the invention, the partition wall may comprise a layer of insulating material. The insulated partition wall between the parts of the outer casing may be used due to the temperature difference between the parts during the operation of the vapor-compression cycle. The insulated partition wall decreases or eliminates thermal conduction between the separate parts of the outer casing.

Typically, in a device according to the invention the outer casing functioning as a pressure vessel. In a preferred embodiment of the invention, a partition wall is pressure-proof wall.

In a second embodiment of the present invention, a first part of the outer casing comprises at least two units of the refrigeration or heat pump system selected from the group consisting of an evaporator, a superheater, an economizer, a condenser, a desuperheater, a sub-cooler and an oil cooler, which units of said part are formed by arranging at least a first plate pack and a second plate pack adjacent to each other inside said part of the outer casing for forming a first unit and a second unit of the system, wherein said plate packs have own inlet and outlet connections, or arranging at least a plate pack inside said part of the outer casing, wherein at least a baffle plate is arranged inside a flow passage of the plate pack for forming at least two units of the system to the plate pack inside said part of the outer casing, i.e. the functional units are formed by arranging multiple passes through one plate pack, and a second part of the outer casing comprises at least one unit of the system.

According to the embodiment of the present invention, where at least a first plate pack and a second plate pack having own inlet and outlet connections are arranged adjacent to each other inside one part of the outer casing, the adjacent plate packs can be separated from each other by an intermediate plate or by arranging baffle plates to the flow channels of the plate pack to close flow connections between the plate packs, as disclosed above in the first embodiment of the present invention. A first and/or a second plate pack can be further divided into the separate units of the refrigeration or heat pump system by arranging a baffle plate inside a flow channel of said plate pack. By baffle plate two or more passes can be formed through one plate pack and so one plate pack can comprise two or more units, i.e. functions of the refrigeration or heat pump system. This can be combined with the intermediate plate arranged between the plate packs or baffle plates between the first and the second plate pack, i.e. a part of the units are formed to the adjacent plate packs having own inlet and outlet connections, and a part of the units is formed into said plate packs by a baffle plate for forming multiple passes inside said plate pack part. One part of the outer casing may comprise a plate pack structure defined in the first embodiment of the present invention.

Also, in a second embodiment of the present invention, the adjacent plate packs may have a substantially same diameter, defined by the outer edges of the heat exchange plates, or the adjacent plate packs can be formed from the different sized plate packs. These embodiments are similar as disclosed above in the first embodiment of the present invention. Inlet and outlet connections of the plate packs inside one part of the outer casing can be formed as disclosed in the first embodiment of the present invention. In an embodiment with two separate parts of the outer casing, inlet and outlet connections are arranged through the end plates of the outer casing, wherein there may be a requirement for the inlet and/or outlet connections arranged nested as described in the first embodiment of the present invention.

In a second embodiment of the present invention, a second part of the outer casing may be a reservoir. In an embodiment, one, two or more reservoir(s) may also be arranged inside at least one part of the outer casing.

In a second embodiment of the present invention, both parts of the outer casing comprise own inlet and outlet connection for a heat exchange medium flowing in a shell side or inlet and/or outlet of the reservoir. According to an embodiment of the invention, a shell side is common to the units of the system inside the same part of the outer casing.

A Third Embodiment of the Present Invention

According to a third embodiment of the present invention, a device comprises a first partition wall and a second partition wall, wherein the outer casing is divided into three separate parts: a first part, a second part and a third part of the outer casing, and each of the parts comprises at least one unit of the system.

In an embodiment according to the invention, a shell of the outer casing is continuous shell from the first end plate to the second end plate of the outer casing, i.e. the shell is uniform in the longitudinal direction of said shell, and the shell is divided in the longitudinal direction of the shell to separate parts by a first and a second partition wall between the parts inside the shell. A partition wall is attached, preferably welded, to the inner surface of the shell. In another embodiment, a longitudinal cylindrical shell of the outer casing may be constructed from two or three parts, wherein the shell is continuous covering at least one part of the outer casing. Especially, when the size of the device is increased, the shell may be constructed from two or more separate parts which are attached, preferably welded to each other, wherein they form the longitudinal cylindrical shell of the outer casing. When the shell of the outer casing is formed from two or more parts, the partition wall may be arranged to the structure so that it is between the parts of the shell. According to the invention, the shell of the outer casing is constructed so that the diameter of the longitudinal cylindrical shell is substantially same in all module parts of the arrangement, i.e. the diameter of the shell of outer casing is substantially same from the first end plate to the second end plate of the outer casing.

In a typical embodiment, partition plates divide the inside of the outer casing in horizontal direction to a first part, a second part and a third part. In a typical embodiment, a partition wall is arranged inside the horizontal cylindrical shell mainly vertically. In one embodiment of the invention, the thickness of the partition wall is typically 20-100 mm or 40-100 mm. A partition wall is typically made of same material as the outer casing. In an embodiment of the invention, the partition wall may comprise a layer of insulating material. The insulated partition wall between the parts of the outer casing may be used due to the temperature difference between the parts during the operation of the vapor-compression cycle. The insulated partition wall decreases or eliminates thermal conduction between the separate parts of the outer casing.

Typically, in a device according to the invention the outer casing functioning as a pressure vessel. In a preferred embodiment of the invention, a partition wall is pressure-proof wall.

According to a third embodiment of the present invention, each part of the casing may comprise one, two or more unit(s) selected from the group consisting of an evaporator, a superheater, an economizer, a condenser, a desuperheater, a sub-cooler and an oil cooler, and they can be formed of the plate pack(s) as described in the first and the second embodiment of the present invention. In an embodiment of the invention, one part may comprise a reservoir and other parts comprises one or more units selected from the group consisting of an evaporator, a superheater, an economizer, a condenser, a desuperheater, a sub-cooler and an oil cooler. In an embodiment of the present invention, a device may comprise two or more reservoirs. In an embodiment, one, two or more reservoir(s) may also be arranged inside at least one part of the outer casing.

According to an embodiment of the present invention, when the outer casing of the device comprises three separate parts, at least one part of the outer casing functioning as a reservoir e.g. for refrigerant or oil. In an embodiment of the present invention, the part functioning as a reservoir is a central part of the outer casing. In this embodiment, a first part of the outer casing comprising at least one unit of a refrigeration or heat pump system, a second part of the outer casing comprises a reservoir and a third part comprises at least one unit of the refrigeration or heat pump system. According to an embodiment of the present invention, a central part does not comprise oil separator, but it is arranged separately prior to said reservoir.

In an embodiment with three separate parts of the outer casing, i.e. there is two partition walls, an inlet and/or outlet connection of a plate pack in a first part and/or a third part may be formed through the partition wall(s), wherein the connection opens to a second part of the outer casing, which is a central part of the outer casing. In an embodiment of the invention, the second part of the outer casing arranged between the first and the second part comprises a reservoir, and hence the inlet and/or outlets of the other parts can be formed through the partition wall(s). In an embodiment, a central part of the outer casing may comprise unit(s) formed of plate pack(s).

In a third embodiment of the present invention, each part of the outer casing comprises own inlet and outlet connection for a heat exchange medium flowing in a shell side, or inlet and/or outlet of the reservoir. According to an embodiment of the invention, a shell side is common to the units of the system inside the same part of the outer casing.

Further Embodiments of the Present Invention

A device according to the present invention may comprise three or more partition walls, wherein the device comprises four or more separate parts of the outer casing, wherein each of the parts comprises at least one unit of the system.

Exemplary Embodiments

In a typical embodiment of the present invention a shell side of the units arranged adjacent to each other is common inside the same common outer casing or the same part of the outer casing, and thus the adjacent units are selected e.g. on the basis of the temperature change required by the heat exchanger of said units. The adjacent units may also be selected in an order of the flow in the refrigeration or heat pump system. In an embodiment according to the invention the units arranged to the same plate pack and/or adjacent plate packs may be a condenser, a desuperheater, and a sub-cooler and/or an oil cooler. In an embodiment according to the invention the units arranged to the same plate pack and/or adjacent plate packs may be an evaporator, a superheater and an economizer.

Some embodiments according to the present invention is presented more detailed below and Figures of the present invention. These Figures present only exemplary embodiments of the device comprising at least three units of the refrigeration or heat pump system.

For the sake of clarity, the same reference numbers are used for corresponding parts in different embodiments.

FIG. 1 shows a cross section of device 1 according to an exemplary embodiment of a first embodiment of the present invention for use in a refrigeration or heat pump system. A device 1 comprises an outer casing, which comprises a longitudinal cylindrical shell 2 and end plates 3*a*, 3*b* arranged at both ends of the shell. A device 1 presented in FIG. 1 includes three units of the refrigeration or heat pump system inside the same common outer casing. A device 1 comprises inside the outer casing a first plate pack and a second plate pack arranged adjacent to each other inside the common outer casing and having own inlet and outlet connections 5*a*, 5*b*, 6*a*, 6*b* for forming a first unit 4*a* and a second unit 4*b* of the system. An intermediate plate 7 is arranged between the units 4*a*, 4*b* formed by adjacent plate packs. The second plate pack comprises a baffle plate 8 inside a flow passage 9*a* of the plate pack for forming a third unit 4*c* of the system to said plate pack.

Each unit of the refrigeration or heat pump system in FIG. 1 comprises a stack of heat exchanger plates having at least two openings and arranged on top of each other, and the heat exchange plates are attached to each other as plate pairs, the inner parts of which plate pairs are arranged in connection with each other via flow passages 9*a*, 9*b*, 10*a*, 10*b* formed by the openings of the heat exchange plates.

In FIG. 1, the first plate pack and the second plate pack, which are separated by the intermediate plate 7, has a substantially same diameter, defined by the outer edges of the heat exchange plates. The adjacent plate packs used in the system may also have a different diameter, e.g. a diameter of the first plate pack, which is separated from the second plate pack by the intermediate plate 7 may be smaller than a diameter of the second plate pack.

In FIG. 1, a shell side of the device 1 comprises an inlet connection 11*a* and an outlet connection 11*b*. The shell side comprises three passes, which are formed by the stopper plates 12, 13 arranged between the plate pack and the inner surface of the outer casing. The units of the refrigeration or heat pump system shares a common shell side in a device presented in FIG. 1.

Figure 2:
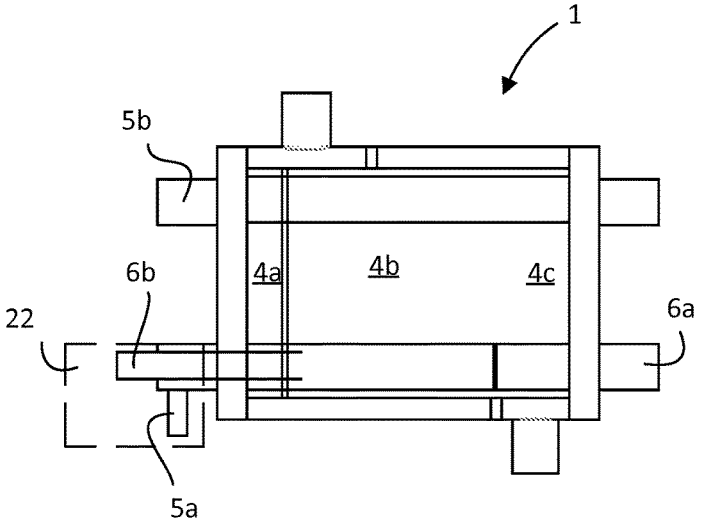
FIG. 2 shows a device of the FIG. 1 connected to a liquid refrigerant container according to an application.

FIG. 2 shows corresponding device 1 as FIG. 1 in an application, where a device 1 comprises three units 4*a*, 4*b*, 4*c* of the refrigeration or heat pump system: a desuperheater (4*c*), a condenser (4*b*) and a sub-cooler (4*a*). In an embodiment presented in FIG. 2, a refrigerant to be condensed is arranged to flow inside the plate packs of the units, i.e. a refrigerant is a heat exchange medium flowing inner parts of the plate packs. This decreases the amount of the refrigerant required in the system. A refrigerant is guided through an inlet connection 6*a* to the desuperheater, from which it flows forward through the condenser and through outlet connection 6*b* the condensed refrigerant is guided to the container 22. From the container 22, the condensed refrigerant is guided through an inlet connection 5*a* to the sub-cooler (4*a*).

A device of FIG. 1 may comprise three units 4*a*, 4*b*, 4*c* of the refrigeration or heat pump system: a desuperheater (4*c*), a condenser (4*b*) and a sub-cooler (4*a*), as disclosed above in the description of FIG. 2. Alternatively, a device 1 presented in Figure may comprise a condenser (4*c*), a sub-cooler (4*b*) and an oil cooler (4*a*). If a second plate pack comprises more than one baffle plates 8 inside the flow passages 9*a*, 9*b* of the plate pack, the second plate pack may comprise e.g. three units of the refrigeration or heat pump system, such as a desuperheater, a condenser and a sub-cooler in same plate pack. Use of a first embodiment according to the present invention is not limited to above-mentioned examples, but the units of the refrigeration or heat pump system can be selected as required in an application.

Figure 3:
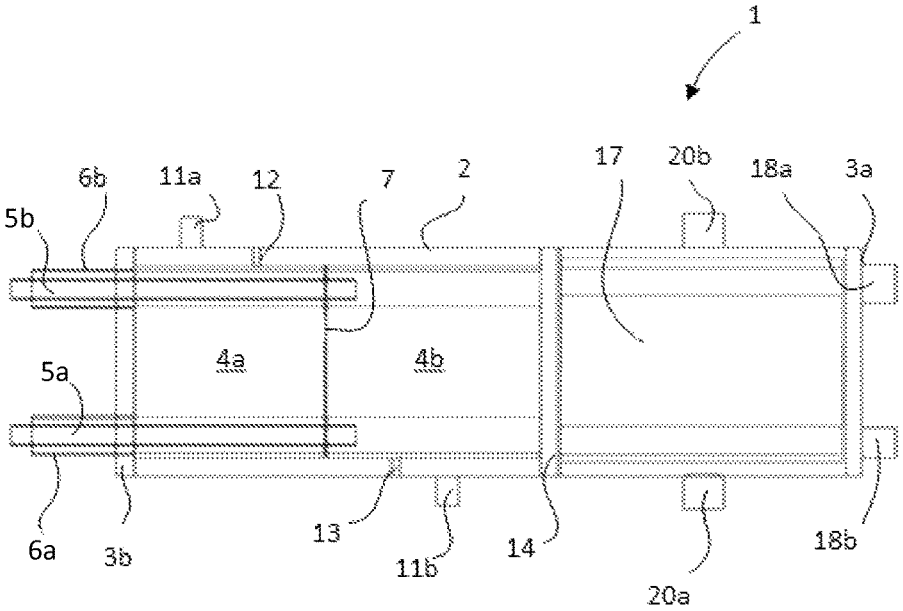
FIG. 3 shows a cross section of a device according to a second embodiment of the present invention for use in a refrigeration or heat pump system.

FIG. 3 shows a cross section of a device 1 according to an exemplary embodiment of a second embodiment of the present invention for use in a refrigeration or heat pump system, which device comprises two separate parts inside a common outer casing. A device 1 comprises an outer casing which comprises a longitudinal cylindrical shell 2 and end plates 3*a*, 3*b* arranged at both ends of the shell. A shell 2 of the outer casing is typically a uniform longitudinal shell from a first end plate 3*a* to the second end plate 3*b*. A shell 2 is divided in the longitudinal direction of the shell to two separate parts by arranging a first partition wall 14 between the parts inside the shell. In a device 1 presented in FIG. 3, a first part comprises at least two units 4*a*, 4*b* of the refrigeration or heat pump system, a second part comprises at least one unit of the refrigeration or heat pump system.

In FIG. 3, the first part of the device 1 comprises a first plate pack and a second plate pack arranged adjacent to each other for forming a first unit 4*a* and a second unit 4*b* of the refrigeration or heat pump system. Both plate packs have own inlet and outlet connections 5*a*, 5*b*, 6*a*, 6*b*. An intermediate plate 7 is arranged between the units 4*a*, 4*b*. Inlet and outlet connections 5*a*, 5*b*, 6*a*, 6*b* of the plate packs are arranged through the same end plate 3*b*, hence the inlet and outlet connections 6*a*, 6*b* of the plate pack forming the second unit 4*b* are arranged through the inlet and outlet connections 5*a*, 5*b* and the flow channels of the plate pack forming the first unit 4*a* and connected to the intermediate plate 7. An intermediate plate 7 blocks the flow connection between the flow channels of the units 4*a*, 4*b*. The shell side of the first part comprises three passes, which are formed by the stopper plates 12, 13 arranged between the plate packs and the inner surface of the outer casing. An inlet connection 11*a* and an outlet connection 11*b* of the shell side are arranged through the shell 2 of the outer casing. The second part of the outer casing comprises a plate pack 17. A heat exchange medium circuit of the plate pack 17 is formed between the inlet and outlet connections 18*a*, 18*b*, a flow direction may be whichever. The second part of the outer casing comprises also the inlet and outlet connections 20*a*, 20*b* of the shell side.

Figure 4:
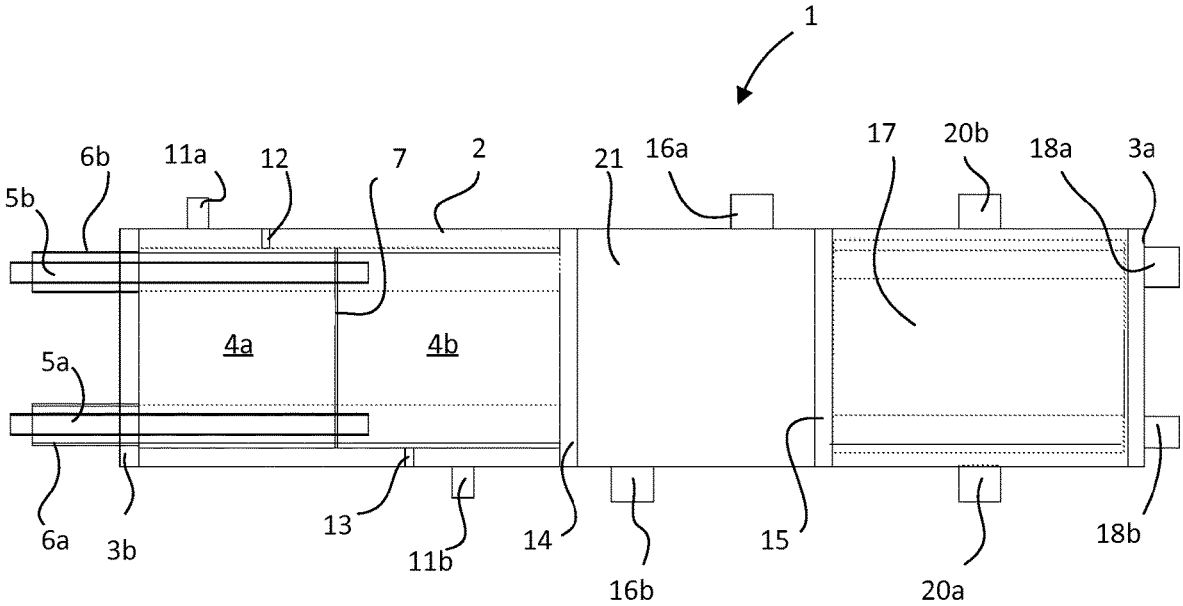
FIG. 4 shows a cross section of a device according to a third embodiment of the present invention for use in a refrigeration or heat pump system.

FIG. 4 shows a cross section of a device 1 according to an exemplary embodiment of a third embodiment of the present invention for use in a refrigeration or heat pump system, which device comprises three separate parts inside a common outer casing. A device 1 comprises an outer casing which comprises a longitudinal cylindrical shell 2 and end plates 3*a*, 3*b* arranged at both ends of the shell. A shell 2 of the outer casing is typically a uniform longitudinal shell from a first end plate 3*a* to the second end plate 3*b*. A shell 2 is divided in the longitudinal direction of the shell to separate parts by arranging a first partition wall 14 and a second partition wall 15 between the parts inside the shell. A shell 2 of the outer casing may also be constructed from three parts, wherein a first partition wall 14 and a second partition wall 15 are arranged between the parts, and the shell 2 is continuous covering at least one part of the device.

In a device 1 presented in FIG. 4, a first part comprises at least two units 4*a*, 4*b* of the refrigeration or heat pump system, a second part (a central part of the outer casing) comprises a reservoir 21 and a third part comprises at least one unit of the refrigeration or heat pump system. The second part comprising a reservoir is arranged as a central part of the device.

In FIG. 4, the first part of the device 1 comprises a first plate pack and a second plate pack arranged adjacent to each other for forming a first unit 4*a* and a second unit 4*b* of the refrigeration or heat pump system. Both plate packs have own inlet and outlet connections 5*a*, 5*b*, 6*a*, 6*b*. An intermediate plate 7 is arranged between the units 4*a*, 4*b*. Inlet and outlet connections 5*a*, 5*b*, 6*a*, 6*b* of the plate packs are arranged through the same end plate 3*b*, hence the inlet and outlet connections 6*a*, 6*b* of the plate pack forming the second unit 4*b* are arranged through the inlet and outlet connections 5*a*, 5*b* and the flow channels of the plate pack forming the first unit 4*a* and connected to the intermediate plate 7. An intermediate plate 7 blocks the flow connection between the flow channels of the units 4*a*, 4*b*. The shell side of the first part comprises three passes, which are formed by the stopper plates 12, 13 arranged between the plate packs and the inner surface of the outer casing. An inlet connection 11*a* and an outlet connection 11*b* of the shell side are arranged through the shell 2 of the outer casing. The second part of the device functioning as a reservoir 21 comprises an inlet connection 16*a* and outlet connection 16*b*. The third part comprises a plate pack 17. A heat exchange medium circuit of the plate pack 17 is formed between the inlet and outlet connections 18*a*, 18*b*, a flow direction may be whichever. The third part comprises also the inlet and outlet connections 20*a*, 20*b* of the shell side.

Figure 5:
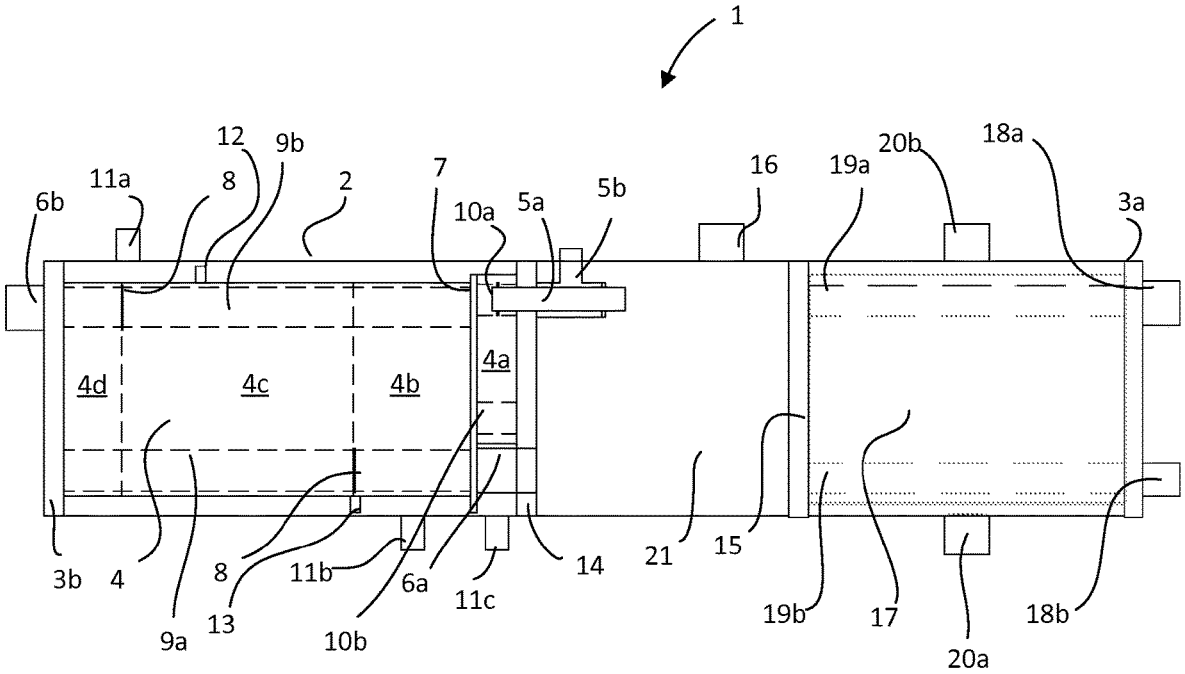
FIG. 5 shows a cross section of another device according to a third embodiment of the present invention for use in a refrigeration or heat pump system.

FIG. 5 shows a cross section of another exemplary embodiment of device 1 according to a third embodiment of the present invention for use in a refrigeration or heat pump system. A device 1 comprises an outer casing which comprises a longitudinal cylindrical shell 2 and end plates 3*a*, 3*b* arranged at both ends of the shell. A shell 2 of the outer casing may be a uniform longitudinal shell from a first end plate 3*a* to the second end plate 3*b*. A shell 2 of the outer casing may also be constructed from three parts as illustrated in FIG. 5, wherein a first partition wall 14 and a second partition wall 15 are arranged between the parts and the shell 2 is continuous covering at least one part of the device.

In FIG. 5, a device according to the present invention comprises five units of the refrigeration or heat pump system and a reservoir inside the common outer casing. A first part of the outer casing comprises four units of the refrigeration or heat pump system. A second part comprises a reservoir. A third part comprises at least one unit of the refrigeration or heat pump system. The second part comprising a reservoir is arranged as a central part of the device.

A first part of the outer casing presented in FIG. 5 comprises two adjacent plate packs, a first plate pack and a second plate pack, and an intermediate plate 7 between the plate packs. In an exemplar embodiment, a first plate pack forms a unit 4*a* of the refrigeration or heat pump system, which may function as an oil cooler. A second plate pack comprises three units 4*b*, 4*c*, 4*d* of the refrigeration or heat pump system formed by arranging baffle plates 8 inside the flow channels 9*a*, 9*b*, for forming multiple passes inside said plate pack. In an exemplary application presented in FIG. 5, the second plate pack may comprise a desuperheater (4*b*), a condenser (4*c*) and a sub-cooler (4*d*).

In FIG. 5, a first plate and a second plate pack have different diameter, defined by the outer edges of the heat exchange plates. The intermediate plate 7 has a size which corresponds with a size of the plate pack having the greater diameter (i.e. the size of the second plate pack). Inlet connection 6*a* of the second plate pack is arranged through the partition plate 14 and the outlet connection 6*b* is arranged through the end plate 3*b*. Inlet connection 6*a* of the second plate pack is arranged outside of the outer surface of the first plate pack and therefore it can be easily arranged through the partition plate 14. A refrigerant to be condensed is arranged to flow through the inlet connection 6*a* to the second plate pack. An inlet and outlet connections 5*a*, 5*b* of the first plate pack are arranged through the partition plate 14. A circuit of the first plate pack, i.e. the unit 4*a*, is formed between the inlet and outlet connections 5*a*, 5*b* and it circulates in the plate pack through flow channels 10*a*, 10*b*.

An inlet connection 5*a* of the first plate pack is arranged inside the outlet connection 5*b* of the first plate pack, wherein the connections 5*a*, 5*b* are nested and the inner connection 5*a* elongates at least partly inside the flow channel 10*a*. The shell side of the first part comprises three passes, which are formed by the stopper plates 12, 13 arranged between the plate packs and the inner surface of the outer casing. An inlet connection 11*a* and the outlet connections 11*b* and 11*c* of the shell side are arranged through the shell 2 of the outer casing. The second part functioning as a reservoir comprises an inlet connection 16.

In an exemplary embodiment of FIG. 5, a unit 4*a* is an oil cooler, a unit 4*b* is a sub-cooler, a unit 4*c* is a condenser and a unit 4*d* is a desuperheater. A cooling medium flows between the inlet connection 11*a* and outlet connections 10*b*, 11*c* inside the shell, wherein an order of the units in the plate packs is selected on the basis of the temperature change required by the heat exchanger of said units.

In FIG. 5, a third part of the outer casing may comprise e.g. an evaporator formed by arranging a plate pack 17 inside the third part. A heat exchange medium circuit of the plate pack 17 is formed between the inlet and outlet connections 18*a*, 18*b*, a flow direction may be whichever. The inlet and outlet connections 18*a*, 18*b* are connected the flow channels 19*a*, 19*b* of the plate pack. The evaporator may be a flooded evaporator, wherein the third part may also comprise a droplet separator above the plate pack functioning as an evaporator. Alternatively, an evaporator may be a DX evaporator. A third part may also comprise e.g. a superheater formed inside the same plate pack with the evaporator by a baffle as described above, or by using adjacent plate packs as described above. The third part comprises also inlet and outlet connections 20*a*, 20*b* of the shell side.

Use of a third embodiment according to the present invention is not limited to above-mentioned examples, but the units of the refrigeration or heat pump system can be selected as required in an application.

The invention claimed is:

1. A device configured for use in a refrigeration or heat pump system, which device comprises an outer casing which comprises a longitudinal cylindrical shell and end plates arranged at both ends of the shell, and at least a first unit, a second unit, and a third unit of the refrigeration or heat pump system arranged inside the same common outer casing, which first, second, and third units are selected from the group consisting of an evaporator, a superheater, an economizer, a condenser, a desuperheater, a sub-cooler, an oil cooler and a reservoir, wherein the device comprises (i) at least a first plate pack and a second plate pack having own inlet and outlet connections and arranged adjacent to each other inside the common outer casing for forming the first unit and the second unit of the system, and further the third unit of the system is formed to the first and/or the second plate pack by arranging a baffle plate inside a flow passage of said plate pack, or (ii) two separate parts of the outer casing, which are formed by arranging a first partition wall between the parts inside the outer casing, wherein the first part of the outer casing comprises at least two units of the system, which at least two units of said part are formed by arranging at least a first plate pack and a second plate pack adjacent to each other inside said part of the outer casing for forming the first unit and the second unit of the system, wherein said plate packs have own inlet and outlet connections, and the first plate pack and the second plate pack are separated from each other by an intermediate plate, which is arranged between the first and second units formed of adjacent plate packs, or arranging at least a plate pack inside said part of the outer casing, wherein at least a baffle plate is arranged inside a flow passage of the plate pack for forming the at least two units of the system to the plate pack inside said part of the outer casing, and a second part of the outer casing comprises at least one unit of the system, or (iii) at least three separate parts of the outer casing, which are formed by arranging a first partition wall and a second partition wall between the parts inside the outer casing, and each of the parts comprises at least one unit of the system.

2. The device according to claim 1, wherein each unit of the refrigeration or heat pump system selected from the group consisting of an evaporator, a superheater, an economizer, a condenser, a desuperheater, a sub-cooler and an oil cooler comprises heat exchanger plates having at least two openings and arranged on top of each other, and the heat exchange plates are attached to each other as plate pairs, the inner parts of which plate pairs are arranged in connection with each other via flow passages formed by the openings of the heat exchange plates.

3. The device according to claim 1, wherein the adjacent first plate pack and the second plate pack having own inlet and outlet connections are formed from a plate pack, wherein baffle plates are arranged to the flow channels of said plate pack to separate flow connections between the plate packs, wherein said plate pack is divided into the first plate pack and the second plate pack.

4. The device according to claim 2, wherein the adjacent first and second plate pack has a substantially same diameter, defined by the outer edges of the heat exchange plates.

5. The device according to claim 1, wherein the first plate pack, which is separated from the second plate pack by the intermediate plate, has a diameter, defined by the outer edges of the heat exchange plates, which is smaller than a diameter of the second plate pack.

6. The device according to claim 1, wherein the first plate pack and/or the second plate pack further comprises one or more baffle plates for forming units to said plate packs.

7. The device according to claim 1, wherein the device comprises a third plate pack arranged adjacent of the first plate pack or the second plate pack, wherein the third plate pack is separated from the adjacent plate pack by arranging an intermediate plate between the third plate pack and the adjacent plate pack and/or by arranging the baffle plates to the flow channels of the plate pack to close flow connection between the plate packs.

8. The device according to claim 1, wherein the device comprises three separate parts and one part of the outer casing functioning as a reservoir.

9. The device according to claim 8, wherein that the part functioning as a reservoir is a central part of the outer casing.

10. The device according to claim 1, further comprising a shell side, which is common to the units of the system inside the outer casing or a separate part of the outer casing.

11. A refrigeration or heat pump system, which comprises at least one device according to claim 1.

12. The device according to claim 2, wherein the adjacent first plate pack and the second plate pack having own inlet and outlet connections are formed from a plate pack, wherein baffle plates are arranged to the flow channels of said plate pack to separate flow connections between the plate packs, wherein said plate pack is divided into the first plate pack and the second plate pack.

13. The device according to claim 2, wherein the adjacent first and second plate pack has a substantially same diameter, defined by the outer edges of the heat exchange plates.

14. The device according to claim 4, wherein the adjacent first and second plate pack has a substantially same diameter, defined by the outer edges of the heat exchange plates.

15. The device according to claim 2, wherein the first plate pack, which is separated from the second plate pack by the intermediate plate, has a diameter, defined by the outer edges of the heat exchange plates, which is smaller than a diameter of the second plate pack.

16. The device according to claim 4, wherein the first plate pack, which is separated from the second plate pack by the intermediate plate, has a diameter, defined by the outer edges of the heat exchange plates, which is smaller than a diameter of the second plate pack.

17. A device configured for use in a refrigeration or heat pump system, which device comprises an outer casing which comprises a longitudinal cylindrical shell and end plates arranged at both ends of the shell, and at least a first unit, a second unit, and a third unit of the refrigeration or heat pump system arranged inside the same common outer casing, which first, second, and third units are selected from the group consisting of an evaporator, a superheater, an economizer, a condenser, a desuperheater, a sub-cooler, an oil cooler and a reservoir, wherein the device comprises (i) at least a first plate pack and a second plate pack having own inlet and outlet connections and arranged adjacent to each other inside the common outer casing for forming the first unit and the second unit of the system, and further the third unit of the system is formed to the first and/or the second plate pack by arranging a baffle plate inside a flow passage of said plate pack, or (ii) two separate parts of the outer casing, which are formed by arranging a first partition wall between the parts inside the outer casing, wherein the first part of the outer casing comprises at least two units of the system, which at least two units of said part are formed by arranging at least a first plate pack and a second plate pack adjacent to each other inside said part of the outer casing for forming the first unit and the second unit of the system, wherein said plate packs have own inlet and outlet connections, or arranging at least a plate pack inside said part of the outer casing, wherein at least a baffle plate is arranged inside a flow passage of the plate pack for forming the at least two units of the system to the plate pack inside said part of the outer casing, and a second part of the outer casing comprises at least one unit of the system, or (iii) at least three separate parts of the outer casing, which are formed by arranging a first partition wall and a second partition wall between the parts inside the outer casing, and each of the parts comprises at least one unit of the system, wherein each unit of the refrigeration or heat pump system selected from the group consisting of an evaporator, a superheater, an economizer, a condenser, a desuperheater, a sub-cooler and an oil cooler comprises heat exchanger plates having at least two openings and arranged on top of each other, and the heat exchange plates are attached to each other as plate pairs, the inner parts of which plate pairs are arranged in connection with each other via flow passages formed by the openings of the heat exchange plates.

18. A device configured for use in a refrigeration or heat pump system, which device comprises an outer casing which comprises a longitudinal cylindrical shell and end plates arranged at both ends of the shell, and at least a first unit, a second unit, and a third unit of the refrigeration or heat pump system arranged inside the same common outer casing, which first, second, and third units are selected from the group consisting of an evaporator, a superheater, an economizer, a condenser, a desuperheater, a sub-cooler, an oil cooler and a reservoir, wherein the device comprises (i) at least a first plate pack and a second plate pack having own inlet and outlet connections and arranged adjacent to each other inside the common outer casing for forming the first unit and the second unit of the system, and further the third unit of the system is formed to the first and/or the second plate pack by arranging a baffle plate inside a flow passage of said plate pack, or (ii) two separate parts of the outer casing, which are formed by arranging a first partition wall between the parts inside the outer casing, wherein the first part of the outer casing comprises at least two units of the system, which at least two units of said part are formed by arranging at least a first plate pack and a second plate pack adjacent to each other inside said part of the outer casing for forming the first unit and the second unit of the system, wherein said plate packs have own inlet and outlet connections, or arranging at least a plate pack inside said part of the outer casing, wherein at least a baffle plate is arranged inside a flow passage of the plate pack for forming the at least two units of the system to the plate pack inside said part of the outer casing, and a second part of the outer casing comprises at least one unit of the system, or (iii) at least three separate parts of the outer casing, which are formed by arranging a first partition wall and a second partition wall between the parts inside the outer casing, and each of the parts comprises at least one unit of the system, wherein the adjacent first plate pack and the second plate pack having own inlet and outlet connections are formed from a plate pack, wherein baffle plates are arranged to the flow channels of said plate pack to separate flow connections between the plate packs, wherein said plate pack is divided into the first plate pack and the second plate pack.

* * * * *